US012116795B2

(12) United States Patent
Shirley-Smith

(10) Patent No.: US 12,116,795 B2
(45) Date of Patent: Oct. 15, 2024

(54) STACKED TEMPORARY LODGINGS AND CONNECTORS

(71) Applicant: Alex Shirley-Smith, London (GB)

(72) Inventor: Alex Shirley-Smith, London (GB)

( * ) Notice: Subject to any disclaimer, the term of this patent is extended or adjusted under 35 U.S.C. 154(b) by 142 days.

(21) Appl. No.: 17/976,930

(22) Filed: Oct. 31, 2022

(65) Prior Publication Data

US 2024/0141677 A1 May 2, 2024

(51) Int. Cl.

| | |
|---|---|
| ***E04H 15/18*** | (2006.01) |
| ***E04H 15/04*** | (2006.01) |
| ***E04H 15/16*** | (2006.01) |
| ***E04H 15/32*** | (2006.01) |
| ***E04H 15/34*** | (2006.01) |
| ***E04H 15/56*** | (2006.01) |
| ***E04H 15/58*** | (2006.01) |
| ***E04H 15/62*** | (2006.01) |

(52) U.S. Cl.

CPC ..... *E04H 15/18* (2013.01); *E04H 15/04* (2013.01); *E04H 15/16* (2013.01); *E04H 15/322* (2013.01); *E04H 15/34* (2013.01); *E04H 15/56* (2013.01); *E04H 15/58* (2013.01); *E04H 15/62* (2013.01)

(58) Field of Classification Search

CPC ..... E04H 15/04; E04H 15/18; E04H 15/322; E04H 15/324; E04H 15/425; E04H 15/56

USPC ..... 135/90, 97, 116, 119, 120.3, 120.4, 907; 52/236.3, 236.6

See application file for complete search history.

(56) References Cited

U.S. PATENT DOCUMENTS

| | | | | | |
|---|---|---|---|---|---|
| 2,880,741 | A * | 4/1959 | McGrand | E04H 15/42 | 135/117 |
| 3,739,536 | A * | 6/1973 | Ward | E04H 15/44 | 52/63 |
| 4,067,346 | A * | 1/1978 | Husted | E04H 15/001 | 135/153 |
| 4,305,414 | A * | 12/1981 | Bareis | E04H 15/56 | 135/906 |
| 4,938,243 | A * | 7/1990 | Foster | E04H 15/48 | 135/901 |
| 5,159,948 | A * | 11/1992 | Moreau | E04H 15/18 | 135/125 |
| 5,240,021 | A * | 8/1993 | Snodgrass | E04H 15/425 | 5/127 |
| 5,487,402 | A * | 1/1996 | Clary | E04H 15/44 | 135/900 |
| 6,109,280 | A * | 8/2000 | Custer | A47D 15/00 | 5/98.1 |
| 6,123,091 | A * | 9/2000 | Flynn | A47D 13/063 | 135/132 |

(Continued)

FOREIGN PATENT DOCUMENTS

WO WO-8402065 A1 * 7/1984

*Primary Examiner* — Robert Canfield

(74) *Attorney, Agent, or Firm* — Michael J. Feigin, Esq.; Feigin and Fridman LLC

(57) ABSTRACT

A stacked temporary lodging, including a lower insulated cabin, having side walls and a top cover, and an upper tent, having a base surface disposed adjacent and above the top cover of the lower insulated cabin, and a top surface. A plurality of tensioned straps are attached to the lower insulated cabin and extend over the top surface of the upper tent. A plurality of fasteners attach an upper edge of the lower insulated cabin to the base surface of the upper tent.

14 Claims, 7 Drawing Sheets

(56) References Cited

U.S. PATENT DOCUMENTS

| | | | | |
|---|---|---|---|---|
| 6,347,638 | B1 * | 2/2002 | Scott | E04H 15/04 135/96 |
| 6,904,924 | B2 * | 6/2005 | Warner | E04H 15/34 135/144 |
| D652,885 | S * | 1/2012 | Frey | D21/834 |
| 8,684,020 | B1 * | 4/2014 | Shires | E04H 15/00 135/97 |
| 9,512,632 | B2 * | 12/2016 | Cook | E04H 15/001 |
| 9,788,639 | B2 * | 10/2017 | Frazer | E04H 15/324 |
| 9,869,110 | B2 * | 1/2018 | Krenzel | E04H 15/50 |
| 10,443,263 | B2 * | 10/2019 | LaHood | E04H 15/64 |
| 11,008,772 | B2 * | 5/2021 | Tillotson | A45F 3/52 |
| D1,004,030 | S * | 11/2023 | Shirley-Smith | D21/834 |
| 2005/0177938 | A1 * | 8/2005 | Steiner | E04H 15/04 5/120 |
| 2011/0017251 | A1 * | 1/2011 | Overbaugh | E04H 15/44 135/117 |
| 2014/0014150 | A1 * | 1/2014 | Horner | E04H 15/04 135/90 |
| 2014/0158174 | A1 * | 6/2014 | Rhett, Jr. | A45F 3/22 135/121 |
| 2016/0053507 | A1 * | 2/2016 | Bozikis | E04H 15/54 135/90 |
| 2019/0119943 | A1 * | 4/2019 | Shirley-Smith | B63B 35/58 |
| 2020/0040599 | A1 * | 2/2020 | Laue | E04H 1/1205 |
| 2020/0123801 | A1 * | 4/2020 | Tillotson | A45F 3/52 |
| 2022/0251869 | A1 * | 8/2022 | Thomas | E04H 15/58 |

* cited by examiner

STACKED TEMPORARY LODGINGS AND CONNECTORS

FIELD OF THE DISCLOSED TECHNOLOGY

The present disclosure relates generally to temporary lodgings such as tents and cabins, and more specifically to stacked temporary lodgings having connectors therebetween.

BACKGROUND OF THE DISCLOSED TECHNOLOGY

People often use cabins and tents while camping or vacationing. One disadvantage of use of cabins and tents is the existence of a single space, which is the hollow of the tent, and no privacy within the tent. Additionally, often a family needs additional space in the tent, but does not want to increase the footprint of the tent.

There remains a need in the art for a cabin or tent having multiple private spaces, which are securely connected to each other.

SUMMARY OF THE DISCLOSED TECHNOLOGY

In accordance with an embodiment of the disclosed technology, there is provided a stacked temporary lodging, including a lower insulated cabin, having side walls and a top cover, and an upper tent, having a base surface disposed adjacent and above the top cover of the lower insulated cabin, and a top surface. A plurality of tensioned straps are attached to the lower insulated cabin and extend over the top surface of the upper tent. A plurality of fasteners attach an upper edge of the lower insulated cabin to the base surface of the upper tent.

In some embodiments, the upper tent has a plurality of support-anchoring straps extending outwardly therefrom, each support-anchoring strap attached to the upper tent by a ring connector, the support-anchoring straps adapted to anchor the upper tent to a corresponding plurality of supports, at a height corresponding to a height of the lower insulated cabin.

In some embodiments, the lower insulated cabin includes a plurality of anchoring straps, each extending between upper edges of two of the side walls, each of the plurality of anchoring straps passing through a corresponding one of the ring connectors, thereby to attach the lower insulated cabin to the plurality of supports, via the support-anchoring straps.

In some embodiments, at least one of the side walls of the lower insulated cabin includes a window, openable and securable in an open position.

In some embodiments, the stacked temporary lodging further includes at least one insulated extension chamber adapted to be reversibly attached, using a reversible attachment mechanism, to the exterior of the at least one of the side walls of the insulated cabin, such that the window forms a passage between the lower insulated cabin and the insulated extension chamber. In some embodiments, the reversible attachment mechanism includes a plurality of zippers.

In some embodiments, the top cover includes a top hatch, and the base surface of the upper tent includes a bottom hatch, the top hatch and the bottom hatch being aligned to allow passage between the lower insulated cabin and the upper tent. In some embodiments, the top cover is attached to the base surface of the upper tent by corresponding toggle fasteners disposed about the top hatch and the bottom hatch, respectively.

In some embodiments, the stacked temporary lodging further includes a base including a ground sheet and a plurality of side walls extending upwardly from the ground sheet, the ground sheet disposed beneath the lower insulated cabin with the side walls of the base disposed along, and exterior to, a lower end of the side walls of the lower insulated cabin. In some embodiments, the base is formed of an ultra-high molecular weight polyethylene. In some embodiments, the base has anchoring loops extending outwardly therefrom, the anchoring loops adapted to receive stakes to secure the base to the ground.

In some embodiments, each side wall of the lower insulated cabin has two of the plurality of tensioned straps attached thereto, adjacent edges of the side wall, and wherein at least one fastener is disposed along the upper edge of the side wall, between the two of the plurality of tensioned straps.

In some embodiments, the stacked temporary lodging further includes a rain cover disposed over the upper tent and the lower insulated cabin, and attached to the ground.

In accordance with an embodiment of the disclosed technology, there is further provided a kit for forming a stacked temporary lodging, the kit including a lower insulated cabin, having side walls and a top cover, and an upper tent, having a base surface adapted to be disposed adjacent and above the top cover of the lower insulated cabin, and a top surface. A plurality of tensioned straps are attached to the lower insulated cabin and are adapted to extend over the top surface of the upper tent. A plurality of fasteners are attached to an upper edge of the lower insulated cabin and a corresponding plurality of fasteners are attached to the base surface of the upper tent, the plurality of fasteners and the corresponding plurality of fasteners being adapted for attachment of the top cover to the base surface.

In some embodiments, the upper tent has a plurality of support-anchoring straps extending outwardly therefrom, each support-anchoring strap attached to the upper tent by a ring connector, the support-anchoring straps adapted to anchor the upper tent to a corresponding plurality of vertical supports, such that the base surface will be disposed above the ground.

In some embodiments, the lower insulated cabin includes a plurality of anchoring straps, each extending between upper edges of two of the side walls, each of the plurality of anchoring straps adapted to pass through a corresponding one of the ring connectors thereby to attach the lower insulated cabin to the plurality of supports, via the support-anchoring straps.

In some embodiments, at least one of the side walls of the lower insulated cabin includes a window, openable and securable in an open position, and the kit further includes at least one insulated extension chamber adapted to be reversibly attached, using a reversible attachment mechanism, to the exterior of the at least one of the side walls of the insulated cabin, such that when the insulated extension chamber is attached to the side wall, the window forms a passage between the lower insulated cabin and the insulated extension chamber.

In some embodiments, the kit further includes a base including a ground sheet and a plurality of side walls extending upwardly from the ground sheet, the ground sheet adapted to be disposed beneath the lower insulated cabin with the side walls of the base disposed along, and exterior to, a lower end of the side walls of the lower insulated cabin.

In some embodiments, each side wall of the lower insulated cabin has two of the plurality of tensioned straps attached thereto, adjacent edges of the side wall, and wherein at least one of the plurality of fasteners is disposed along the upper edge of the side wall, between the two of the plurality of tensioned straps.

In some embodiments, the kit further includes a rain cover adapted to be disposed over the upper tent and the lower insulated cabin, and attached to the ground.

In accordance with an embodiment of the disclosed technology, there is further provided a temporary lodging structure, including flexible side walls and a top cover defining a generally enclosed interior region. The temporary lodging structure further includes at least three anchoring points provided at corners of the structure, generally level with the top cover. The temporary lodging structure also includes tension elements extending between the anchoring points at least along edges of the top cover, so that the shape of the top cover is maintained when outward tension is applied to the anchoring points.

In some embodiments, the side walls extend downwardly from the top cover.

In some embodiments, one or more securing arrangements are provided at or near a lower edge of each of the side walls, to allow connection of the lower edges of the side walls to respective anchoring points.

In some embodiments, the temporary lodging structure further includes side apertures in at least some of the side walls. The side apertures may be selectively openable.

In some embodiments, the temporary lodging structure further includes a top aperture formed in the top cover. The top aperture may be selectively openable.

In some embodiments, the temporary lodging structure further includes a bottom surface, which extends between the lower edges of the side walls. In some embodiments, the bottom surface has a bottom aperture formed therein. In some embodiments, the bottom aperture may be selectively openable.

"Substantially" and "substantially shown," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

The disclosed technology relates to a stacked temporary lodging, including a lower insulated cabin, having side walls and a top cover, and an upper tent, having a base surface disposed adjacent and above the top cover of the lower insulated cabin, and a top surface. A plurality of tensioned straps are attached to the lower insulated cabin and extend over the top surface of the upper tent. A plurality of fasteners attach an upper edge of the lower insulated cabin to the base surface of the upper tent.

Embodiments of the disclosed technology will become clearer in view of the following description of the Figures.

Figure 1A:
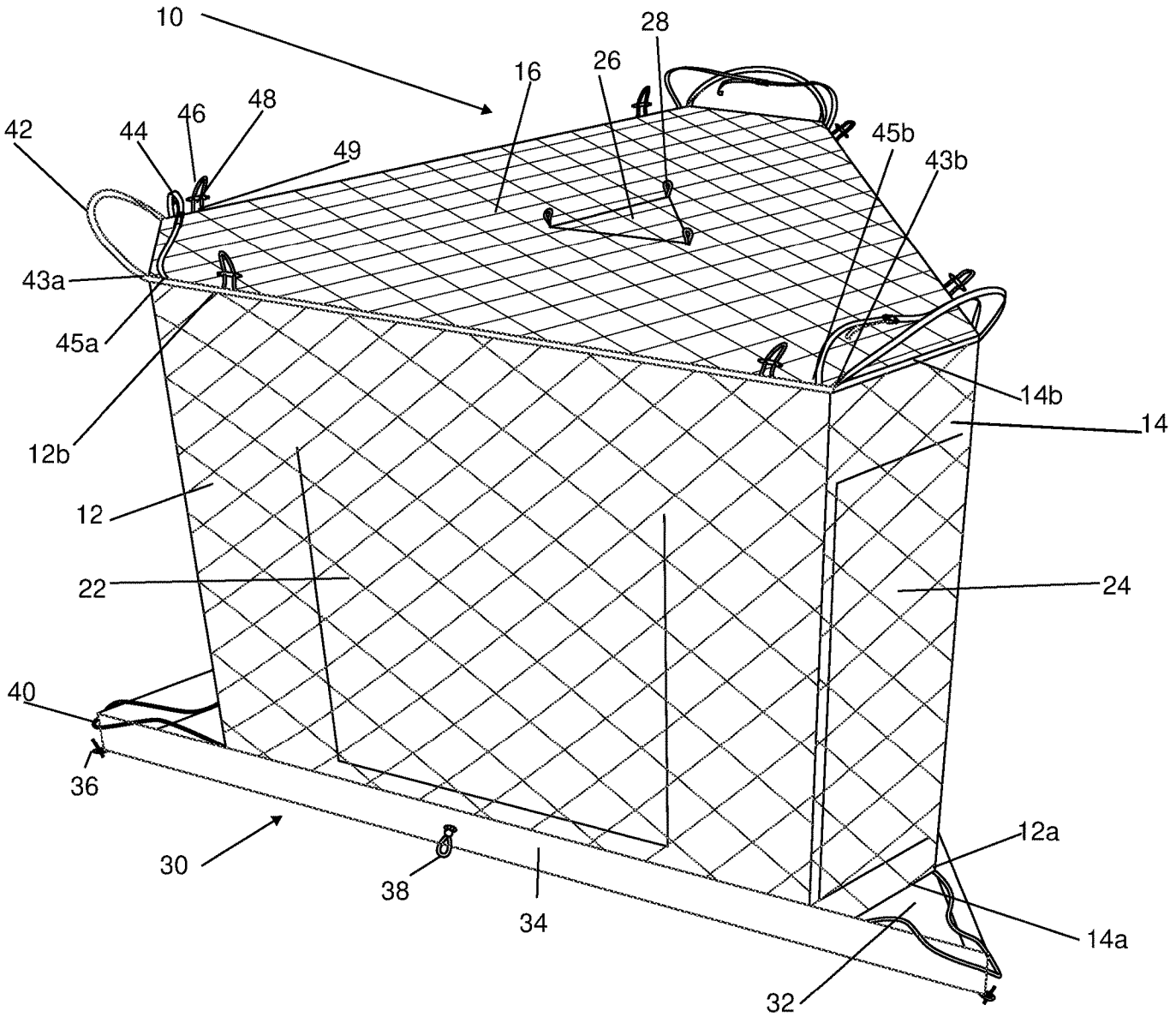
FIG. 1A is a schematic perspective view illustration of a lower cabin, according to an embodiment of the disclosed technology.
Figure 1B:
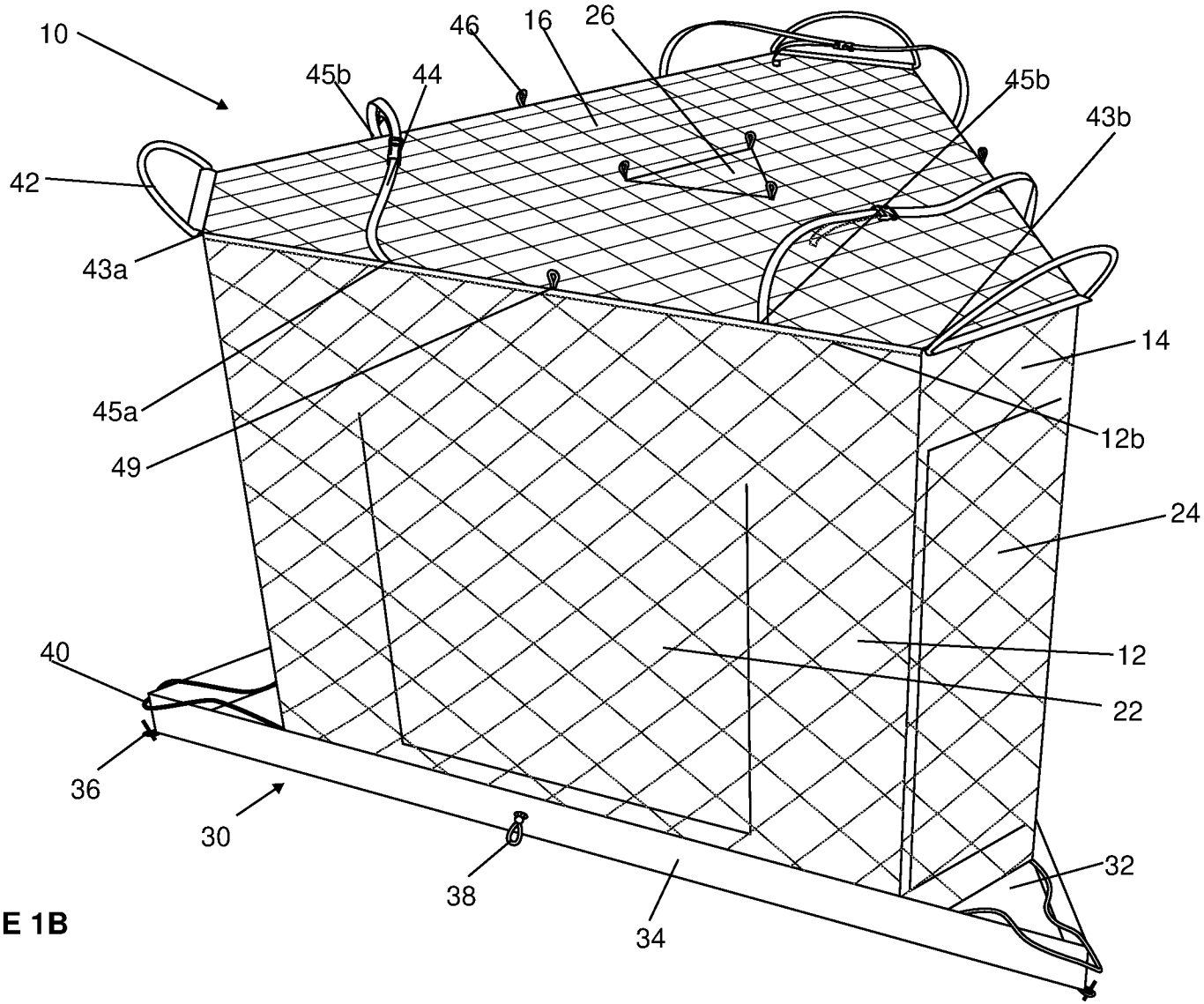
FIG. 1B is a schematic perspective view illustration of a lower cabin, according to another embodiment of the disclosed technology.

FIGS. 1A and 1B are schematic perspective view illustrations of a lower cabin 10, according to embodiments of the disclosed technology. Lower cabin 10 includes a plurality of side walls 12, and a corresponding plurality of corner walls 14. Each corner wall 14 connects two side walls 12, to form a truncated corner therebetween. As seen, corner walls 14 are narrower than side walls 12. Each of side walls 12 has a lower edge 12*a* and an upper edge 12*b*, and each of corner walls 14 has a lower edge 14*a* and an upper edge 14*b*. In the illustrated embodiment, lower cabin 10 is substantially triangular, and includes three side walls 12 and three corner walls 14. A top cover 16 is disposed above walls 12 and 14, in contact with upper edges 12*b* and 14*b*, to form the ceiling of lower cabin 10. Walls 12 and 14, together with top cover 16, define a hollow space within the cabin.

At least some of side walls 12 may include a window 22, openable upwards. At least one of corner walls 14 includes a door 24, openable inwards into the hollow space of the cabin, or outwards. Top cover 16 includes a central hatch 26, which is openable and can be secured in an open position. In some embodiments, central hatch 26 has a plurality of loops 28 formed therearound, for securing hatch 26 to a corresponding hatch of an upper cabin, as explained in further detail hereinbelow.

Lower cabin 10 is adapted to be placed on the ground. In order to keep the cabin dry, the lower edges 12*a* and 14*a* of walls 12 and 14 are disposed on a base 30, including ground sheet 32 and side walls 34. Ground sheet 32 is shown as a triangular sheet. Side walls 34 extend upward of ground sheet 32, about walls 12 of lower cabin 10, protecting the base of walls 12 from rain splash and keeping them dry. In some embodiments, base 30 may be formed of polyethylene, such as ultra-high molecular weight polyethylene. For example, base 30 may be formed of PE 8,000.

In some embodiments, side walls 34 of base 30 may be fastened to each other at lateral ends thereof, for example by zippers, to ensure strong attachment therebetween.

In some embodiments, base 30 further includes anchoring loops 36, which may be disposed at corners thereof. Anchoring loops 36 may be suitable for passing stakes therethrough, in order to anchor the base to the ground. In some embodiments, at least some of side walls 34 may include a size adjustment mechanism 38, for example in the form of a loop and fastener, to ensure that the side walls 34 fit tightly about side walls 12 of lower cabin 10.

In some embodiments, side walls 12 may have lower anchoring straps 40 a corner of lower edge 12*a* of each side wall 12 to a corresponding corner of the lower edge 12*a* of an adjacent side wall 12, about corner wall 14, such that the anchoring straps 40 each form a corner. Lower anchoring straps 40 may extend over corners of side walls 34, and around stakes placed through anchoring loops 36, to ensure anchoring of lower cabin 10 to the ground. Alternately, lower anchoring straps 40 may be used, in combination with the connection mechanism of FIGS. 3A and 3B, for hanging of lower cabin 10 above ground, substantially as described herein.

Upper anchoring straps 42 extend from an attachment point 43*a* at a corner of upper edge 12*b* of each side wall 12 to an attachment point 43*b* at a corresponding corner of the upper edge 12*b* of an adjacent side wall 12, about corner wall 14. In some embodiments, upper anchoring straps 42 are sufficiently long to form a triangular corner, virtually completing the truncated corner of lower cabin 10.

Tensioned straps 44 extend from an attachment point 45*a* along upper edge 12*b* of each side wall 12 to a corresponding attachment point 45*b* along upper edge 12*b* of the adjacent side wall 12, such that two tensioned straps 44 are attached to upper edge 12*b* of each side wall 12. One or more loops 46 extend upwardly from upper edge 12*b* of each side wall 12, and are attached to the upper edge 12*b* at attachment points 49. The attachment points 45*a* and 45*b* of each of tensioned straps 44 and the attachment points 49 of each of loops 46 to side wall 12 are disposed between attachment points 43*a* and 43*b* of upper anchoring straps 42. In some embodiments, upper anchoring straps 42 may be connected at one of attachment points 43*a* or 43*b* by a clipping mechanism.

In the embodiment of FIG. 1A, attachment points 45*a* and 45*b* of each tensioned strap 44 are close to respective attachment points 43*a* and 43*b* of upper anchoring strap 42. Additionally, two loops are provided adjacent each of tensioned straps 44, each functionally associated with a fastener or button 48. Attachment points 49 of loops 46 are disposed relatively close to attachment points 45*a* and 45*b*. As such, each attachment point 45*a* is disposed between an attachment point 49 and an attachment points 43*a*. Similarly, each attachment point 45*b* is disposed between an attachment point 49 and an attachment point 43*b*.

In the embodiment of FIG. 1B, attachment points 45*a* and 45*b* of each tensioned strap 44 are further from respective attachment points 43*a* and 43*b* of upper anchoring strap 42. Additionally, a single loop is provided substantially at the center of upper edge 12*b*. In some embodiments, the length of upper edge 12*b* is divided into four substantially equidistant segments by attachment points 45*a*, 45*b*, and 49: a first segment from attachment point 43*a* to attachment point 45*a*; a second segment from attachment point 45*a* to attachment point 49; a third segment from attachment point 49 to attachment point 45*b*; and a fourth segment from attachment point 45*b* to attachment point 43*b*. Tensioned straps 44 are sufficiently long to extend loosely above top cover 16 at their attachment location.

In some embodiments, lower cabin 10 may be formed of, or covered with, an insulating material.

Figure 2:
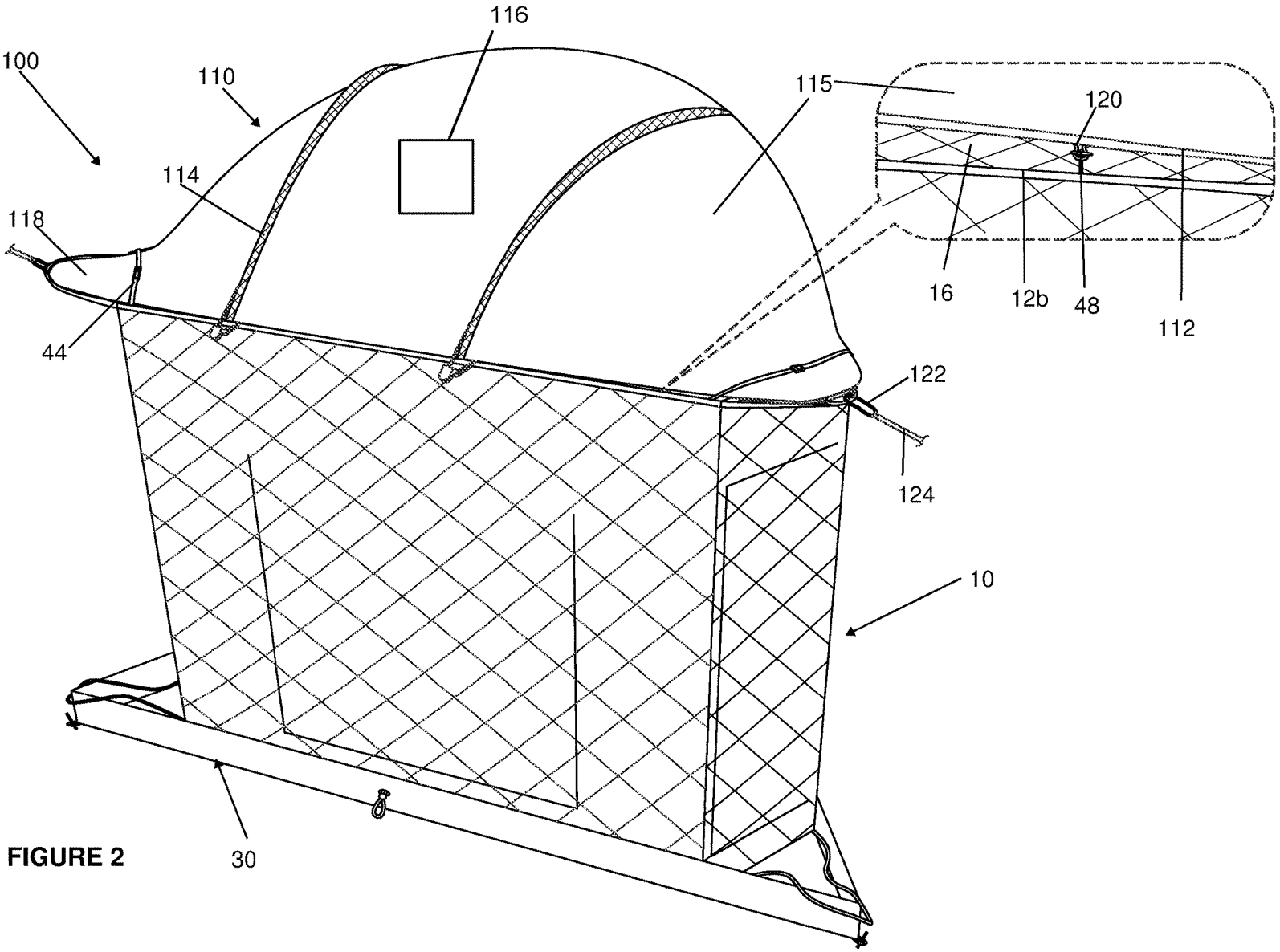
FIG. 2 is a schematic perspective view illustration of a stacked temporary lodging including the lower cabin of FIG. 1A and an upper tent, according to embodiments of the disclosed technology.

FIG. 2 is a schematic perspective view illustration of a stacked temporary lodging 100 including lower cabin 10 of FIG. 1A and an upper tent 110, according to embodiments of the disclosed technology.

Upper tent 110 is mounted above lower cabin 10, such that a base surface 112 of upper tent 110 abuts top cover 16 of lower cabin 10. Upper tent 110 may be any tent suitable for anchoring above ground, such as a tree tent. A tree tent can be a tent with three or four corners which are attached to tensioned cord, each tensioned cord attached to a tree such that the tent is suspended above ground and to the trees/poles. Further, a hatch on a bottom side of the tent allows for ingress/egress in/out of the tent.

For example, upper tent 110 may have an arched or pyramidal construction supported by one or more poles. In the illustrated embodiment, upper tent 110 is supported by two arched poles 114, extending from base surface 112 to hold up a canopy 115 of tent 110. Upper tent 110 may be formed of a waterproof and/or UV resistant material.

Typically, base surface 112 includes a hatch 116, which is aligned with hatch 26 of top cover 16, to enable passage from the lower cabin to the upper tent.

As seen, tensioned straps 44 are wrapped and tensioned above rounded corners 118 of upper tent 110. Additionally, loops 120 extending from edges of base surface 112 connect to fasteners 48, thus further fixing the upper tent to the lower cabin, as shown in the enlarged portion of FIG. 2.

Figure 3A:
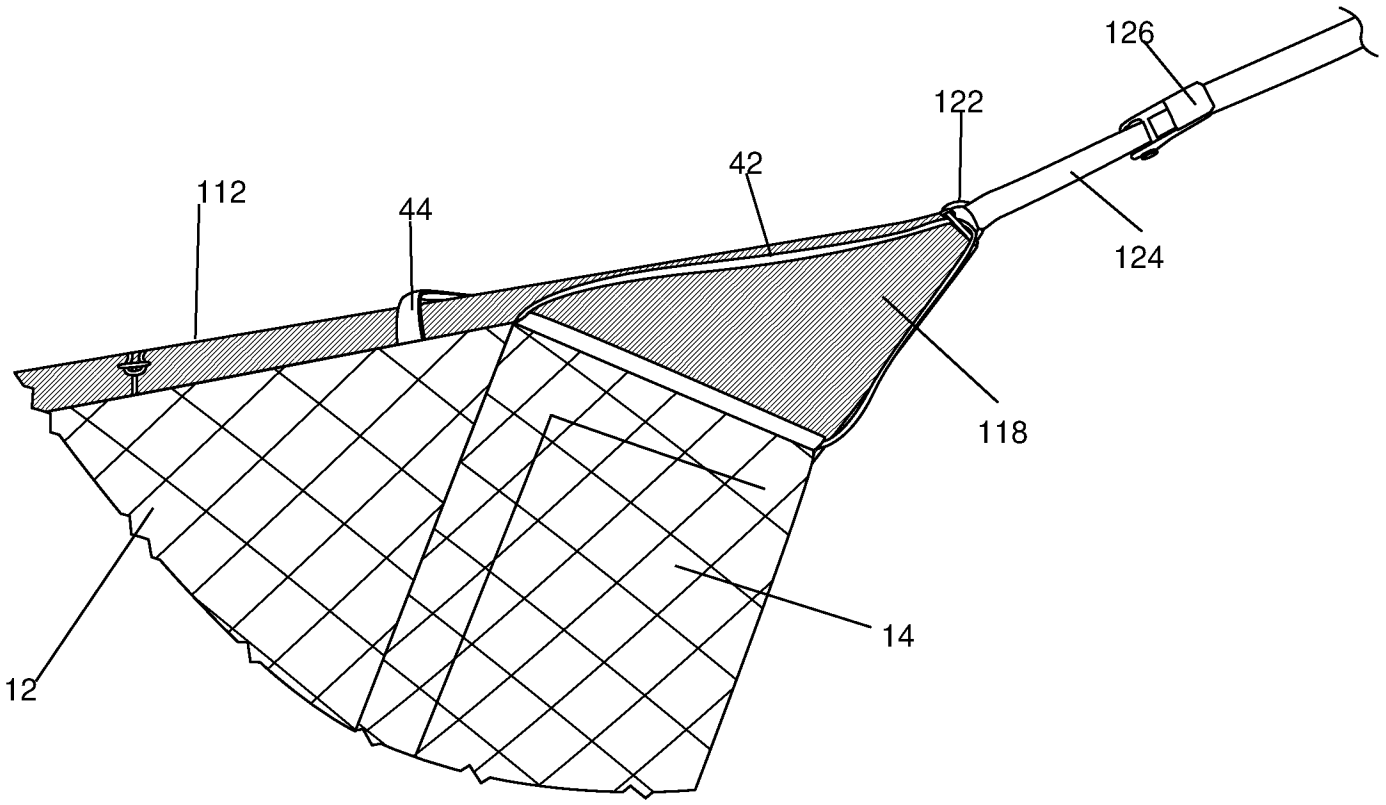
FIG. 3A is a schematic illustrations of a connection mechanism for connecting the lower cabin and the upper tent in the stacked temporary lodging of FIG. 2, according to embodiments of the disclosed technology.
Figure 3B:
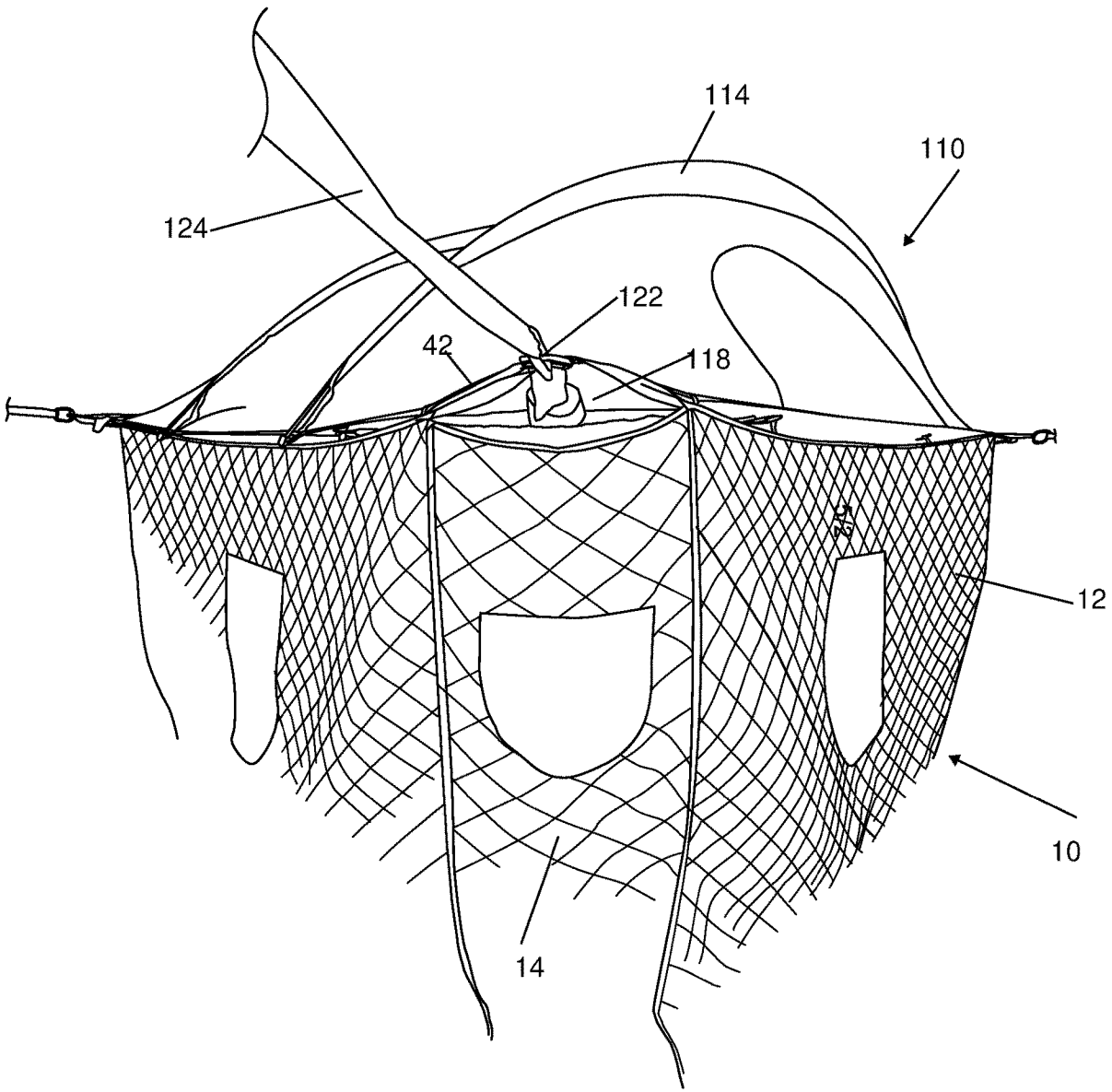
FIG. 3B is a back-view schematic illustrations of a connection mechanism for connecting the lower cabin and the upper tent in the stacked temporary lodging of FIG. 2, according to embodiments of the disclosed technology.

Reference is now additionally made to FIGS. 3A and 3B, which are schematic illustrations of a connection mechanism for connecting the lower cabin and the upper tent in the stacked temporary lodging of FIG. 2, according to embodiments of the disclosed technology. As seen in FIGS. 3A and 3B, each of corners 118 of upper tent 110 is connected to a ring 122, such as a D-ring, which in turn is connected to a support-anchoring strap 124. For example, strap 124 may be tensioned by way of a ratchet 126, or using any other tensioning or toggling mechanism. Upper anchoring straps 42, which may be webbing straps, extend through ring 122, thereby securing upper edges 12*b* of lower cabin 10 to support-anchoring strap 124. Each support-anchoring strap 124 is adapted to be anchored to an exterior support, such as a tree. Anchoring of the support-anchoring straps 124 to the support ensures that lower cabin 10 and upper tent 110 maintain their respective heights, and are stable enough to withstand ambient conditions, such as wind and rain.

In some embodiments, an additional rain cover (not explicitly shown) may be draped over the entire stacked temporary lodging 100, and staked to the ground around base 30.

Figure 4A:
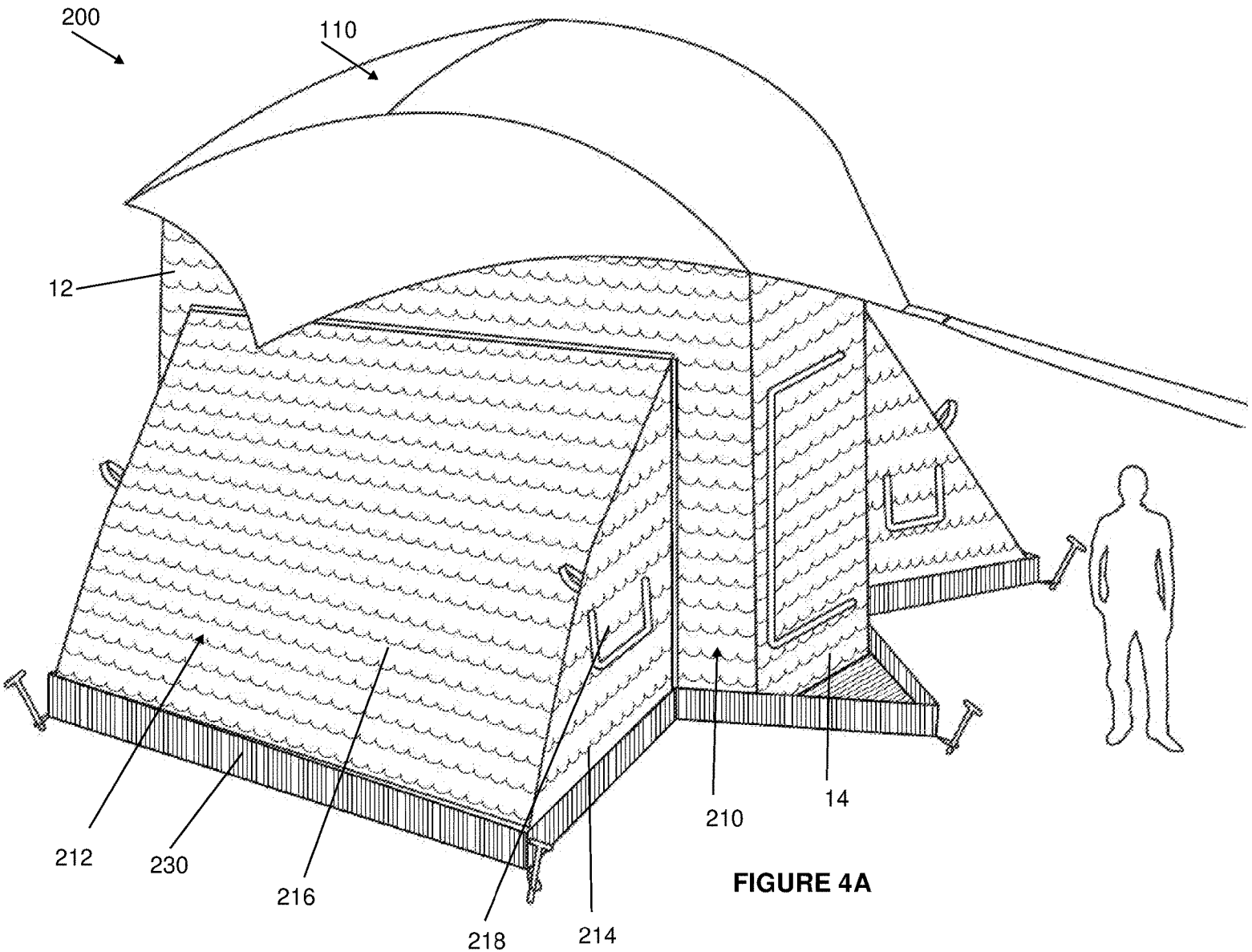
FIG. 4A is a schematic perspective view illustration of a stacked temporary lodging in which the lower cabin has multiple chambers, according to embodiments of the disclosed technology.
Figure 4C:
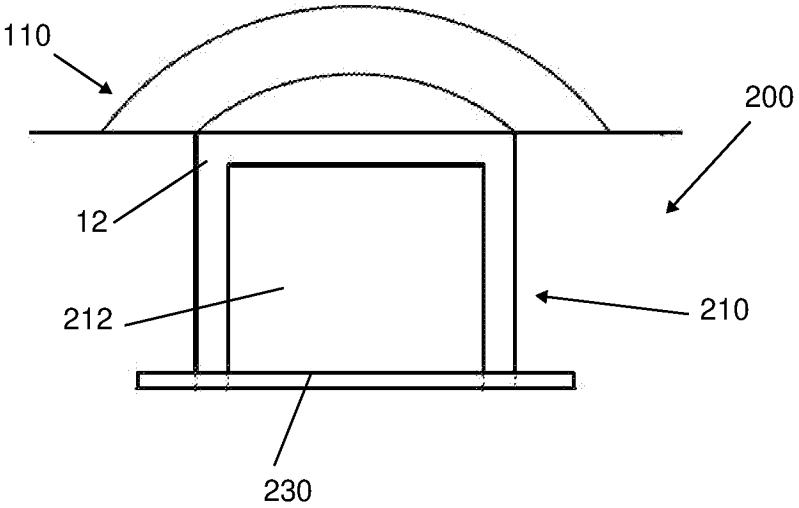
FIG. 4C is a side view planar illustration of the stacked temporary lodging of FIG. 4A.
Figure 4B:
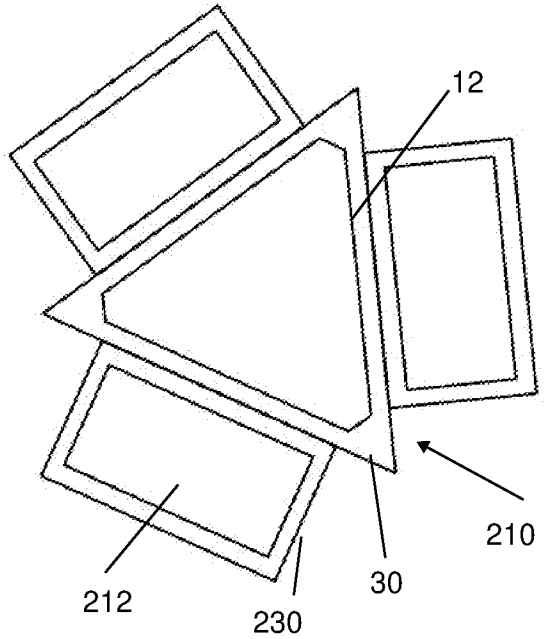
FIG. 4B is a top view planar illustration of the stacked temporary lodging of FIG. 4A.

Reference is now made to FIGS. 4A, 4B, and 4C are, respectively, a schematic perspective view illustration, a top view planar illustration, and a side view planar illustration of a stacked temporary lodging 200 including a lower cabin 210 having multiple chambers and an upper tent 110, according to embodiments of the disclosed technology. Upper tent 110 may be substantially similar to that described hereinabove with respect to FIGS. 1A to 3B.

In lower cabin 210, each side wall 12 has an extension 212 extending outwardly therefrom, which extension forms an additional chamber, e.g. a sleeping chamber, of the cabin. Each extension 212 includes two substantially triangular side walls 214, each forming a right-angle triangle, and an outer wall 216. In some embodiments, windows 22 in side walls 12 enable passage from the main chamber of cabin 210, between side walls 12, into each additional chamber 212. In some embodiments, side walls 214 include windows 218.

In some embodiments, extensions 212 may be reversibly attachable and detachable to side walls 12, for example by zipped attachment along vertical edges of side walls 214 and along an upper horizontal edge of outer wall 216.

In some embodiments, base 30 may have rectangular extensions 230, shown clearly in FIG. 4B, which are disposed beneath extensions 212. Rectangular extensions 230 include a ground sheet and side walls, similarly to base 30 of FIGS. 1A and 1B.

For use of stacked temporary lodgings 100 or 200, initially the upper tent is installed at the desired height, by anchoring it to surrounding supports. For example, a triangular tent 110 may be connected to three surrounding trees using straps 124 and ratchets 126, at a height of approximately 2.5 meters.

Subsequently, lower cabin 10 or 210 is placed beneath the upper tent, on base 30. A corner wall 14 of lower cabin 10 is lifted using upper anchoring strap 42, to meet the suspended tent. Upper anchoring strap 42 is then threaded through D-ring 122, if necessary clipped back, and tightened. The process of attachment of upper anchoring straps 42 to D-rings 122 is repeated for each corner of the cabin.

Tensioned straps 44 are thrown over each of the corners of upper tent 110, and are clipped and cinched tight on each side of the cabin, to secure the upper tent to the lower cabin. Loops 46 and fasteners 48 are toggled to corresponding loops 120 on the base of upper tent 110 along the exterior edge of upper tent 110. These steps ensure that the side walls 112 of lower cabin 10 or 210 are held upright and are attached to the upper tent 110.

In order to ensure that top cover 16 of lower cabin 10 does not sag, loops 28 surrounding hatch 26 of lower cabin 10 are attached to corresponding loops and/or toggle fasteners surrounding the corresponding hatch 116 in base 112 of upper tent 110. This provides attachment of the lower cabin to the upper tent closer to the center of the lower cabin, and facilitates passage between the lower cabin and upper tent, via the aligned hatches.

When constructing stacked temporary lodging 210 of FIGS. 4A to 4C, extensions 212 are attached to side walls 12, by dedicated zippers or fasteners, once the lower cabin is set up and anchored to the upper tent.

Finally, the stacked temporary lodging may be covered with a rain protector draped over the upper tent and along the sides of the lower cabin. The rain protector may be staked to the ground surrounding base 30.

In the examples discussed above, the lower cabin 10, 210 is used in conjunction with an upper tent 110. In other embodiments, the lower cabin 10, 210 can be used in isolation, with no additional structure positioned above it (aside from a rain protector or similar).

In yet further embodiments, an upper cabin (not shown), similar to the lower cabin 10, 210 discussed above, may be positioned on top of the lower cabin 10, 210, to create a composite dwelling structure. As disclosed herein the lower cabin 10, 210 may have a central hatch 26 formed in its top cover 16. The upper cabin may include a central hatch in its lower surface, which is aligned or substantially aligned with the central hatch 26 in the top cover 16 of the lower cabin 10, 210, to allow occupants to move between the lower cabin 10, 210 and the upper cabin.

In such embodiments, the upper cabin may have no further significant structure there-above, may have an upper tent positioned above it (for instance as shown in the attached figures), or may have a yet further cabin positioned above it.

It is envisaged that the upper cabin may be held in place at least partly through attachment to the exterior supports, which may be the same exterior supports to which the straps 124 of the lower cabin 10, 210 are attached. The lower side of the upper cabin may also be attached to the upper side of the lower cabin 10, 210, in any suitable way.

It should be understood that all subject matter disclosed herein is directed, and should be read, only on statutory, non-abstract subject matter. All terminology should be read to include only the portions of the definitions which may be claimed.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A stacked temporary lodging, comprising:

a lower insulated cabin, having side walls and a top cover;

an upper tent, having a base surface disposed adjacent and above the top cover of the lower insulated cabin, and a top surface;

a plurality of tensioned straps attached to the lower insulated cabin and extending over the top surface of the upper tent; and a plurality of fasteners attaching an upper edge of the lower insulated cabin to the base surface of the upper tent.

2. The stacked temporary lodging of claim 1, wherein the upper tent has a plurality of support-anchoring straps extending outwardly therefrom, each support-anchoring strap attached to the upper tent by a ring connector, the support-anchoring straps adapted to anchor the upper tent to a corresponding plurality of supports, at a height corresponding to a height of the lower insulated cabin.

3. The stacked temporary lodging of claim 2, wherein the lower insulated cabin includes a plurality of anchoring straps, each extending between upper edges of two of said side walls, each of the plurality of anchoring straps passing through a corresponding one of the ring connectors, thereby to attach the lower insulated cabin to the plurality of supports, via the support-anchoring straps.

4. The stacked temporary lodging of claim 1, wherein at least one of the side walls of the lower insulated cabin includes a window, the stacked temporary lodging further comprising at least one insulated extension chamber reversibly attached to the exterior of the at least one of the side walls of the insulated cabin, such that the window defines a portal between the lower insulated cabin and the insulated extension chamber.

5. The stacked temporary lodging of claim 1, wherein the top cover comprises a top hatch, and the base surface of the upper tent comprises a bottom hatch, the top hatch and the bottom hatch being aligned and creating a portal between the lower insulated cabin and the upper tent.

6. The stacked temporary lodging of claim 5, wherein a plurality of toggle fasteners are arranged along edges of the top hatch, a corresponding plurality of fasteners are arranged along edges of the bottom hatch, and the top cover is attached to the base surface of the upper tent by the attachment of the plurality of toggle fasteners to the corresponding plurality of fasteners.

7. The stacked temporary lodging of claim 1, further comprising a base including a ground sheet and a plurality of side walls extending upwardly from the ground sheet, the ground sheet disposed beneath the lower insulated cabin with the side walls of the base disposed along, and exterior to, a lower end of the side walls of the lower insulated cabin.

8. The stacked temporary lodging of claim 1, wherein each side wall of the lower insulated cabin has two of the plurality of tensioned straps attached thereto, adjacent edges of the side wall, and wherein at least one fastener is disposed along the upper edge of the side wall, between the two of the plurality of tensioned straps.

9. A kit for forming a stacked temporary lodging, the kit comprising:

a lower insulated cabin, having side walls and a top cover;

an upper tent, having a base surface adapted to be disposed adjacent and above the top cover of the lower insulated cabin, and a top surface;

a plurality of tensioned straps attached to the lower insulated cabin and adapted to extend over the top surface of the upper tent; and a plurality of fasteners attached to an upper edge of the lower insulated cabin and a corresponding plurality of fasteners attached to the base surface of the upper tent, the plurality of fasteners and the corresponding plurality of fasteners adapted for attachment of the top cover to the base surface.

10. The kit of claim 9, wherein the upper tent has a plurality of support-anchoring straps extending outwardly therefrom, each support-anchoring strap attached to the upper tent by a ring connector, the support-anchoring straps adapted to anchor the upper tent to a corresponding plurality of vertical supports, such that the base surface will be disposed above the ground.

11. The kit of claim 10, wherein the lower insulated cabin includes a plurality of anchoring straps, each extending between upper edges of two of said side walls, each of the plurality of anchoring straps adapted to pass through a corresponding one of the ring connectors thereby to attach the lower insulated cabin to the plurality of supports, via the support-anchoring straps.

12. The kit of claim 9, wherein at least one of the side walls of the lower insulated cabin includes a window, openable and securable in an open position, the kit further comprising at least one insulated extension chamber adapted to be reversibly attached, using a reversible attachment mechanism, to the exterior of the at least one of the side walls of the insulated cabin, such that when the insulated extension chamber is attached to the side wall, the window forms a passage between the lower insulated cabin and the insulated extension chamber.

13. The kit of claim 9, further comprising a base including a ground sheet and a plurality of side walls extending upwardly from the ground sheet, the ground sheet adapted to be disposed beneath the lower insulated cabin with the side walls of the base disposed along, and exterior to, a lower end of the side walls of the lower insulated cabin.

14. The kit of claim 9, wherein each side wall of the lower insulated cabin has two of the plurality of tensioned straps attached thereto, adjacent edges of the side wall, and wherein at least one of the plurality of fasteners is disposed along the upper edge of the side wall, between the two of the plurality of tensioned straps.

* * * * *